United States Patent [19]

McPhail

[11] 4,095,343

[45] Jun. 20, 1978

[54] BUILDING LAYOUT TEMPLATES

[76] Inventor: J. C. McPhail, 8530 W. Pinetta Dr., Richmond, Va. 23235

[21] Appl. No.: 789,313

[22] Filed: Apr. 20, 1977

[51] Int. Cl.[2] ..... E04G 21/18

[52] U.S. Cl. ..... 33/1 LE; 33/86; 33/286

[58] Field of Search ..... 33/1 H, 1 LE, 85, 86, 33/286

[56] References Cited

U.S. PATENT DOCUMENTS

| | | | |
|---|---|---|---|
| 1,327,198 | 1/1920 | Carlson | 33/1 LE |
| 2,562,597 | 7/1951 | Breuninger | 33/86 |
| 3,318,004 | 5/1967 | Payne | 33/85 |
| 3,381,379 | 5/1968 | Fergen | 33/1 LE |
| 3,823,480 | 7/1974 | Grundman | 33/1 LE |

*Primary Examiner*—William D. Martin, Jr.

*Attorney, Agent, or Firm*—Griffin, Branigan and Butler

[57] ABSTRACT

Each of four templates comprises crossed strips which define straight edges for aligning masons lines. Additional strips are fixed to, and extend perpendicularly from, one end of each of the cross strips. Notches in these additional strips define pin locations for wall and footing lines.

10 Claims, 3 Drawing Figures

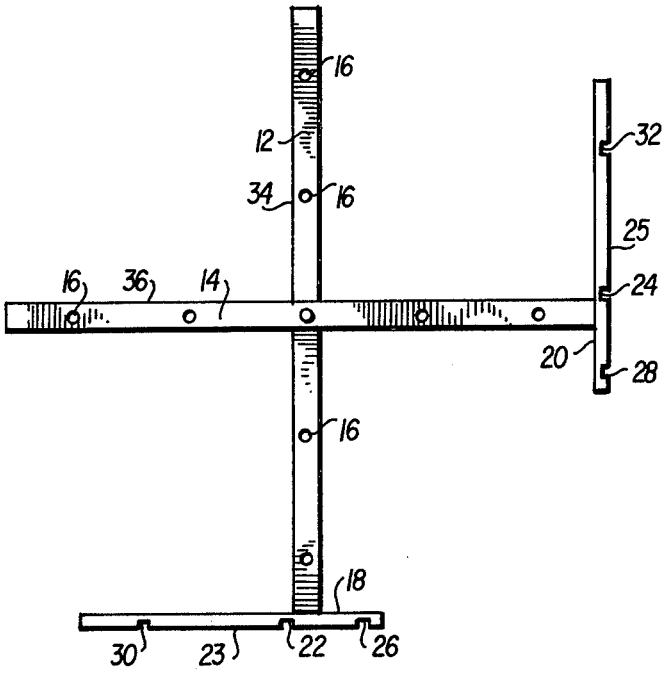
FIG. 1
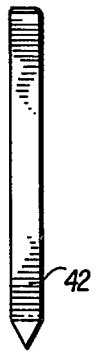
FIG. 3
FIG. 2
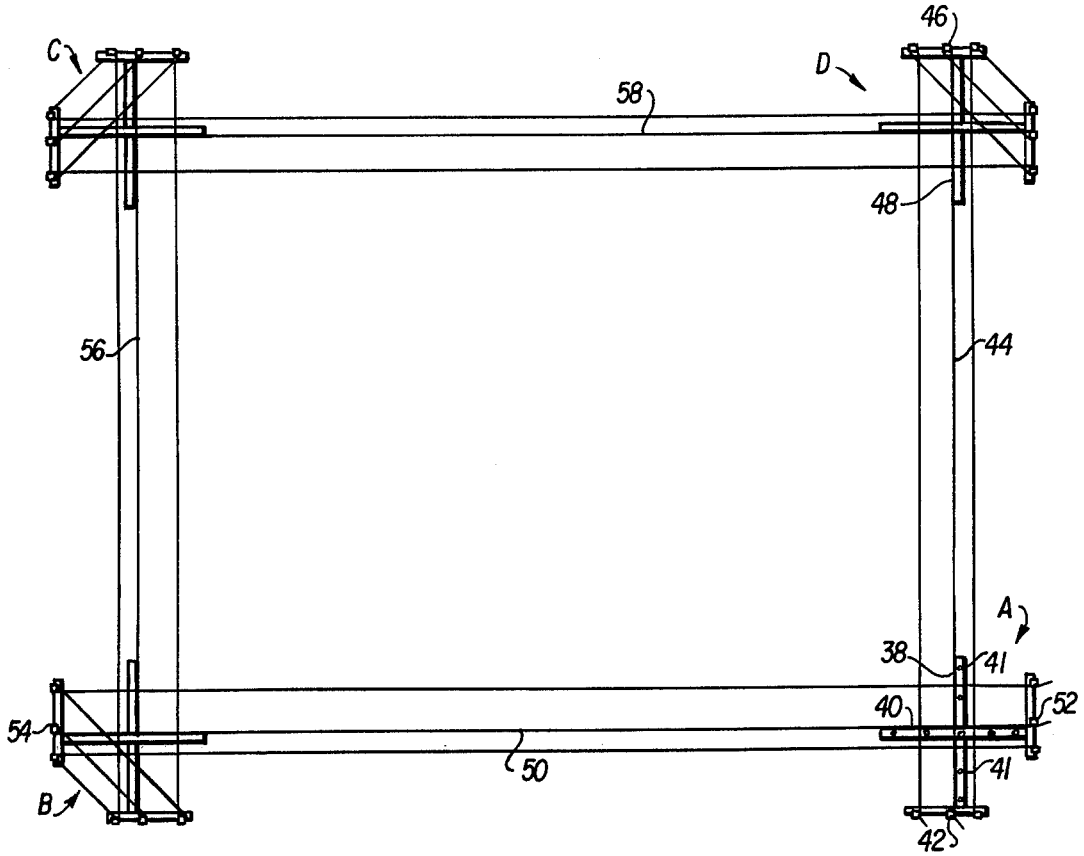

BUILDING LAYOUT TEMPLATES

BACKGROUND OF THE INVENTION

This invention relates to building-layout templates which enable one or more persons to establish corners for buildings and layout building wall and footing lines.

Particularly with small buildings, a contractor may often find that surveyors or engineers are not immediately available for laying wall and footing lines for a building. Also, a contractor or others may wish to avoid the expense of a surveyor or engineer by laying his own lines. Generally, however, when a contractor or others attempts to lay his own lines, he runs into several difficulties, the most significant of which is the problem of providing corners of exactly 90° while accurately meeting specifications as to wall length.

In the past, contractors have used protractors comprising crossed arms to lay out a second mason line perpendicular to a first in order to accurately provide a 90° corner. Examples of such protractors are found in U.S. Pat. Nos. 1,401,200 to Smith, 2,685,739 to Cole, and 2,665,482 to Rupp. In addition, in the prior art it is necessary to have devices, generally known as batter boards, at the corners of building sites. Examples of such batter boards are found in U.S. Pat. Nos. 2,562,597 to Breuninger, 2,934,826 to Klaum, 3,318,004 to Payne, and 3,823,480 to Grundman. Batter boards comprise two perpendicular arms which may be fixed to the ground by stakes or the like outside the area in which the footing is to be set, and to which the wall and footing lines may be attached. It is difficult to use protractors with lines attached to batter boards and the batter boards after being set, are often in the way.

It is an object of this invention to provide a building layout template whereby 90° corners may be accurately defined and whereby footings as well as wall lines may be layed using a single instrument for each corner.

SUMMARY OF THE INVENTION

A template is provided with first and second corssed edges along which wall lines may be aligned. Additional means are provided on the template for accurately locating pins for wall and footing lines along lines perpendicular to the crossed edges.

DESCRIPTION OF THE DRAWINGS

The foregoing and other objects, features, and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating principles of the invention.

FIG. 1 is a plan view of a template made in accordance with the invention;

FIG. 2 is a plan view showing four templates of FIG. 1 in position after the laying of wall and footing lines; and, FIG. 3 is a side elevational view of a locating pin used in the apparatus of FIGS. 1 and 2.

DESCRIPTION OF A PREFERRED EMBODIMENT OF THE INVENTION

Referring to FIG. 1, each template comprises crossed strips 12 and 14. In the preferred embodiment, the strips are fixed perpendicular to each other. Holes 16 are provided in each strip for receiving elongated round pins having round heads for mounting the template to the ground. At the end of each strip 12 and 14, respective strips 18 and 20 are fixed perpendicular thereto. Wall line locating notches 22 and 24 are respectively formed in strips 18 and 20 along respective edges 23 and 25 for wall line locating pins. These notches extend through the strips 18 and 20. Outer footing line locating notches 26 and 28 and inner footing line locating notches 30 and 32 are also provided in respective strips 18 and 20.

The dimensions of the templates are determined by specific applications. Cross strips 12 and 14 are of equal length and must be sufficiently long to permit a visual alignment of masons lines over and parallel to first and second edges 34 and 36 as is more particularly described below. Four-foot strips 12 and 14 have been found to be a satisfactory length.

The length of strips 18 and 20 should be greater than the width of the specified concrete footing. For a 16-inch footing, 2-foot strips have been used. For an 8-inch wall on a 16-inch footing, notches 26 and 28 should be four inches from the respective lines defined by edges 34 and 36 and notches 30 and 32 are 12 inches from the respective lines defined by edges 34 and 36. Each notch is 3/16 inch square in order to receive locating pins 42 having square cross sections of 3/16 inch (FIG. 3). In one desirable embodiment these pins are 12 inches long and do not have heads.

The templates may be stamped or cut from any suitable material such as steel, aluminum, or a composition material such as press wood. Alternately, each template may be manufactured in four separate strips fixed together by screws, wood glue, or any other suitable means.

Referring now to FIG. 2, the use of a set of four templates A, B, C, and D will be described. First template A is placed in position on the ground such that edges 38 and 40 define one corner location of a building with all of the slots 22–32 opening away from the proposed corner. Round headed anchor pins 41 are then driven through the holes 16 provided on the cross strips 12 and 14. With the template thus secured to the ground, a square-section, pointed locating pin 42 (FIG. 3) is driven through a wall line locating notch 22 into the ground.

A 2-inch length of pin 42 is left above ground and a masons line 44 is tied to the pin. A measuring tape is then hooked over the square locating pin 42 to measure out a proper length wall line in the direction of template D. A proper setback is included in the measurement to allow for the distance of each wall line locating notch 22 and 24 from each building corner. The masons line 44 is then stretched taut and sighted to make certain that it is parallel to edge 38. A second locating square pin 46 identical to locating pin 42 is then driven into the ground at the proper point along the masons line 44 (wall length plus double the distance from edge 40 to the locating pin 42 from the locating pin 42). Template D is then positioned with its wall locating-notch 22 engaged with pin 46 away from the proposed building and its edge 48 parallel to line 44. Once properly located, round anchoring pins 41 are driven through the provided holes 16 to firmly secure the template D.

In the same manner, a line 50 is extended from a square pin 52 to locate a square locating pin 54 and position template B. Finally, template C is located by sighting from either template D or B, thus completing the wall lines by laying of lines 56 and 58.

At this point, the positioning of the templates can be checked by measuring diagonal lines between the corners defined by templates A and C and between the corners defined by templates D and B. These diagonals will be equal if the templates were properly placed.

With the templates properly positioned, it is now an easy matter to place additional square pins into the remaining notches and extend footing lines between appropriate pins as shown in FIG. 2. It can be understood that by using the templates of the present invention, no further measurements are required once the building corners are established.

Once the footing lines have properly defined the footing area, a spade or other digging instrument is used to outline the footing below the lines. The lines are then removed, and, while leaving the square locating pins in place, the round pins and each template may be removed. At this point, all fixtures, that is the square locating pins, are outside the area of footing excavation and are available for future use in laying lines after the footing concrete is poured.

From the above, it can be understood that the intersections of wall lines and footing lines are located using a single instrument, and that once the lines are layed, all that need remain for future reference are 24 locating pins set back a convenient distance from the excavated footing.

While the invention has been particularly shown and described with reference to a preferred embodiment thereof, it will be understood by those skilled in the art that various changes in form and detail may be made therein without departing from the spirit and scope of the invention as defined by the appended claims.

I claim:

1. A building layout template for securing corner locations and laying wall and footing lines, the template comprising:

first strip means defining a straight edge of sufficient length to enable visual alignment of a first line parallel to said first strip means with reasonable accuracy;

second strip means defining a straight edge of sufficient length to enable visual alignment of a second line parallel to said second strip means with reasonable accuracy;

said first strip means being affixed to said second strip means at a predetermined angle of intersection so as to define a corner location;

third strip means attached to said first strip means at a point spaced from said corner location by a distance at least as great as the distance desired between said footing lines and having a plurality of end footing line locating means which lie in a line perpendicular to said first strip means;

said third strips means including an end wall line locating means situated at the intersection of said first and third strip means;

fourth strip means attached to said second strip means at a point spaced from said corner location by a distance at least as great as the desired distance between said footing lines and having a plurality of end footing line locating means which lie in a line perpendicular to said second strip means;

said fourth strip means including an end wall line locating means situated at the intersection of said second and fourth strip means and;

said first, second, third and fourth strip means being in the same plane.

2. The building layout template of claim 1 further comprising an anchoring means for fixing said template to the ground.

3. The building layout template of claim 2 wherein said template includes anchoring holes therein and said anchoring means comprises pins inserted through said holes.

4. The building layout template of claim 2 wherein said plurality of end footing line locating means of said third and fourth strip means comprise notches and pins for engaging said notches.

5. The building layout template of claim 4 wherein said pins have square cross sections and said notches are square.

6. The building layout of claim 1 wherein said plurality of end footing line locating means of said third and fourth strip means comprise notches and pins for engaging said notches.

7. The building layout template of claim 6 wherein said pins have square cross sections and said notches are square.

8. The building layout template of claim 2 wherein said first strip means is fixed to said second strip means at a right angle of intersection.

9. The building layout template of claim 1 wherein said first strip means is fixed to said second strip means at a right angle of intersection.

10. A building layout template for establishing corner locations and laying wall and foot lines, the template comprising:

a first strip for defining a first straight edge, said first straight edge being of sufficient length to enable visual alignment of a first wall line parallel to the first straight edge with reasonable accuracy, said first strip having at least one hole therein for accepting pins;

a second strip fixed to said first strip for defining a second straight edge perpendicular to the first straight edge, the intersection of said first and second straight edges to define a corner location, said second straight edge being of sufficient length to enable visual alignment of a second wall line parallel to the second straight edge with reasonable accuracy, said second strip having at least one hole therein for accepting pins;

a third strip fixed to said first strip for defining a third straight edge perpendicular to said first straight edge and intersecting a line colinear with the first straight edge, but spaced away from the intersection of the first and second edges, said third straight edge being of a length at least as great as the desired distance between foot lines, said third strip having notches therein along the third straight edge for accepting and precisely locating wall and footing pins;

a fourth strip fixed to said second strip for defining a fourth straight edge perpendicular to said second straight edge and intersecting a line colinear with the second straight edge, but spaced away from the intersection of the first and second straight edges, said fourth straight edge being of a length at least as great as the desired distance between foot lines, said fourth strip having notches therein along the fourth straight edge for accepting and precisely locating wall and footing pins.

* * * * *